US010730657B1

(12) United States Patent
Spencer

(10) Patent No.: US 10,730,657 B1
(45) Date of Patent: Aug. 4, 2020

(54) FOLDED BOX FOR HOLDING PREPARED FOOD AND BEVERAGES

(71) Applicant: Stephen Spencer, Newtown, PA (US)

(72) Inventor: Stephen Spencer, Newtown, PA (US)

( * ) Notice: Subject to any disclaimer, the term of this patent is extended or adjusted under 35 U.S.C. 154(b) by 0 days.

(21) Appl. No.: 16/379,769

(22) Filed: Apr. 9, 2019

(51) Int. Cl.
*B65D 5/20* (2006.01)
*B65D 5/50* (2006.01)
*B65D 5/48* (2006.01)

(52) U.S. Cl.
CPC ..... *B65D 5/5023* (2013.01); *B65D 5/208* (2013.01); *B65D 5/2057* (2013.01); *B65D 5/48002* (2013.01)

(58) Field of Classification Search
CPC .... B65D 5/5023; B65D 5/2057; B65D 5/208; B65D 5/48002; B65D 5/5021; B65D 71/72; B65D 2571/00925; B65D 5/5286; A47G 23/06
USPC ..... 229/120.18, 904, 120.08, 906, 120.05, 229/178, 120.14; 206/562, 564, 565
See application file for complete search history.

(56) References Cited

U.S. PATENT DOCUMENTS 2,679,971 A * 6/1954 Goldberg ..... B65D 71/72 206/563
2,833,458 A 5/1958 Toensmeier
2,924,372 A 2/1960 Kirkeby
3,189,247 A * 6/1965 Wischusen ..... B65D 5/48018 206/563
4,757,937 A 7/1988 Maio et al.
5,205,474 A 4/1993 Stuart et al.
5,788,081 A * 8/1998 Bates ..... A47G 23/06 206/562
6,213,389 B1 4/2001 Cai
6,568,586 B1 5/2003 VanEsley et al.
7,565,997 B1 * 7/2009 Lim ..... B65D 71/72 229/120.08
2004/0178253 A1 * 9/2004 Stier ..... B65D 5/10 229/120.14
2004/0200891 A1 * 10/2004 Correll ..... B65D 5/5021 229/120.05
2004/0222109 A1 11/2004 Pucillo et al.
2008/0105695 A1 * 5/2008 Moran ..... B65D 33/00 220/694
2010/0032474 A1 * 2/2010 Burton ..... B65D 5/667 229/120.02
2018/0194507 A1 * 7/2018 Thomas ..... B65D 5/0254
2019/0144180 A1 * 5/2019 Mertz, II ..... B65D 71/0022 229/117.16

* cited by examiner

*Primary Examiner* — Christopher R Demeree
(74) *Attorney, Agent, or Firm* — LaMorte & Associates, P.C.

(57) ABSTRACT

The present invention is a folded box that is made from a single stamped blank of paperboard. When folded, a box is formed that contains both a food trough for holding food and a beverage rail for holding beverage cups. The paperboard blank has a base panel. A front panel, a rear panel and two side panels are coupled to the base panel. Slots are formed in the side panels. A cup receptacle panel extends from the rear panel. Locking tabs extend from the cup receptacle panel. The folded box is configurable between a folded configuration and an unfolded configuration. When in the unfolded configuration, the locking tabs on the cup receptacle panel extend through the slots in the side panels, therein mechanically interconnecting the cup receptacle panel to the side panels.

17 Claims, 6 Drawing Sheets

FOLDED BOX FOR HOLDING PREPARED FOOD AND BEVERAGES

BACKGROUND OF THE INVENTION

1. Field of the Invention

In general, the present invention relates to folded boxes and the paperboard blanks that are used to create folded boxes. More particularly, the present invention relates to folded boxes that fold into a configuration adapted to hold a serving of food and at least one beverage.

2. Prior Art Description

Many restaurants, food trucks, food stands, and concession stands sell food that is carried away by the customer for consumption a short distance way, such as in a car, stadium seat or park table. Often, such food is provided to the customer in an open box or tray. In this manner, the customer can access the food as he/she is walking to a seat. When food is provided in a box, the customer does not pay for the box. Rather, the cost of the box is an overhead expense of the food provider. As such, food provider tends to supply boxes that are as inexpensive as possible. The problem is that inexpensive boxes tend to be insubstantial boxes. As such, the boxes provided often lack the strength or integrity to hold more than one servicing of food and perhaps one beverage.

In the prior art there are many types of folded boxes that are intended to carry a serving of food and a beverage. Some of these prior art boxes provide areas within the box for food and a cup receptacle that can hold a beverage. In U.S. Pat. No. 2,833,458 to Toensmeier, a folding box is provided that is made by folding a blank of paperboard. When folded, the box provides an area for food and a receptacle for a cup. However, due to the folding pattern of the paperboard blank, large holes exist in the side walls of the food compartment of the folded box. This obviously undesirable because it allows food to fall out of the food compartment and it also enables surrounding contaminants to enter the food compartment.

In U.S. Pat. No. 6,213,389 to Cai, a folding box is disclosed that is designed to hold both a food and beverages in separate areas. However, the design of the folding box requires that two separate blanks of paperboard be cut and then glued together for form the complete box. The need for two blanks adds significantly to the cost of the folding box, therein making the folding box commercially unviable.

A need therefore exists for a folded paperboard box that is strong, inexpensive, and can be folded from a single stamped blank of paperboard, wherein the box can hold both food and beverages without holes in the box. This need is met by the present invention as described and claimed below.

SUMMARY OF THE INVENTION

The present invention is a folded box that is made from a single stamped blank of paperboard. When folded, a box is formed that contains both a food trough for holding food and a beverage rail for holding beverage cups.

The paperboard blank has a base panel that is defined on the paperboard blank between a first fold line, a second fold line, a third fold line and a fourth fold line. A front panel is coupled to the base panel along the first fold line. Two side panels are coupled to the base panel along the third fold line and the fourth fold line. Slots are formed in the side panels. A rear panel is coupled to the base panel along the second fold line. A cup receptacle panel extends from the rear panel along a fifth fold line. Locking tabs extend from the cup receptacle panel. A support panel extends between the cup receptacle panel and the base panel.

The folded box is configurable between a folded configuration and an unfolded configuration. When in the unfolded configuration, the locking tabs on the cup receptacle panel extend through the slots in the side panels, therein mechanically interconnecting the cup receptacle panel to the side panels. This locks the folded box into its unfolded configuration and ensure that the folded box will not collapse during use. This provides strength and integrity to the box even then a thin piece of paperboard is used for the box blank.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the dimensions of the present invention folding box can be altered to make boxes of different sizes, only two exemplary folded boxes are illustrated and described. The selected folded boxes are sized to hold beverages and a serving of prepared food. The exemplary embodiments are selected in order to set forth two of the best modes contemplated for the invention. The illustrated embodiments, however, are merely exemplary and should not be considered a limitation when interpreting the scope of the appended claims.

Figure 1:
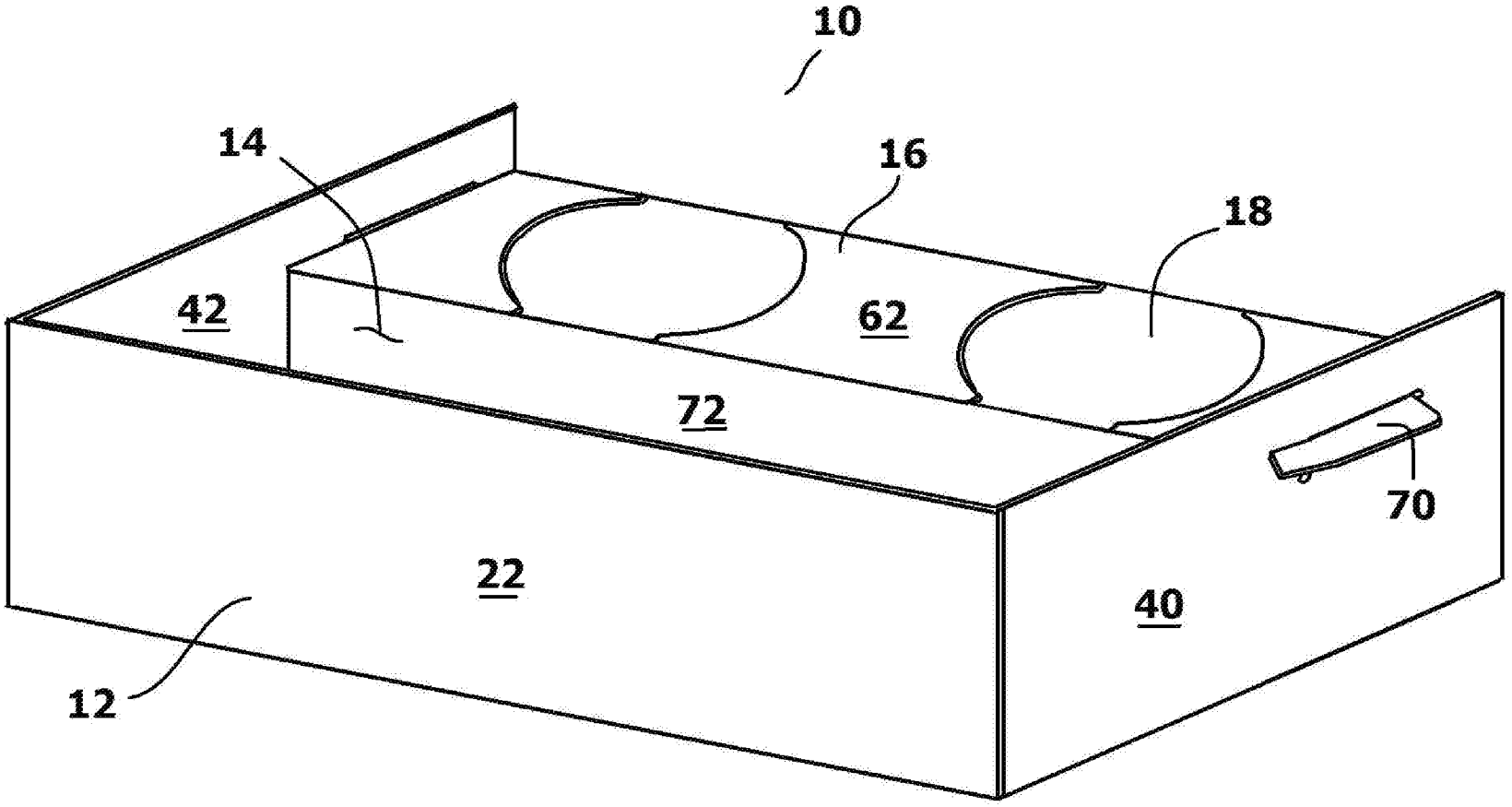
FIG. 1 is a perspective view of an exemplary embodiment of a paperboard box in an open unfolded configuration.

Referring to FIG. 1, a folded box 10 is shown in a fully assembled configuration. The folded box 10 is made from a single paperboard blank 12 and a few applications of adhesive. When assembled, the folded box 10 creates a food and beverage carrier. The folded box 10 creates a food trough 14 that takes up at least half the volume of the folded box 10. The food trough 14 is capable of holding one or more services of prepared food. The folded box 10 also creates a beverage rail 16. The beverage rail 16 contains one of more cup openings 18 for holding cups, cans, bottles or the like. In the shown embodiment, the beverage rail 16 has two cup openings 18 and is therefore configured to hold two beverages.

Figure 2:
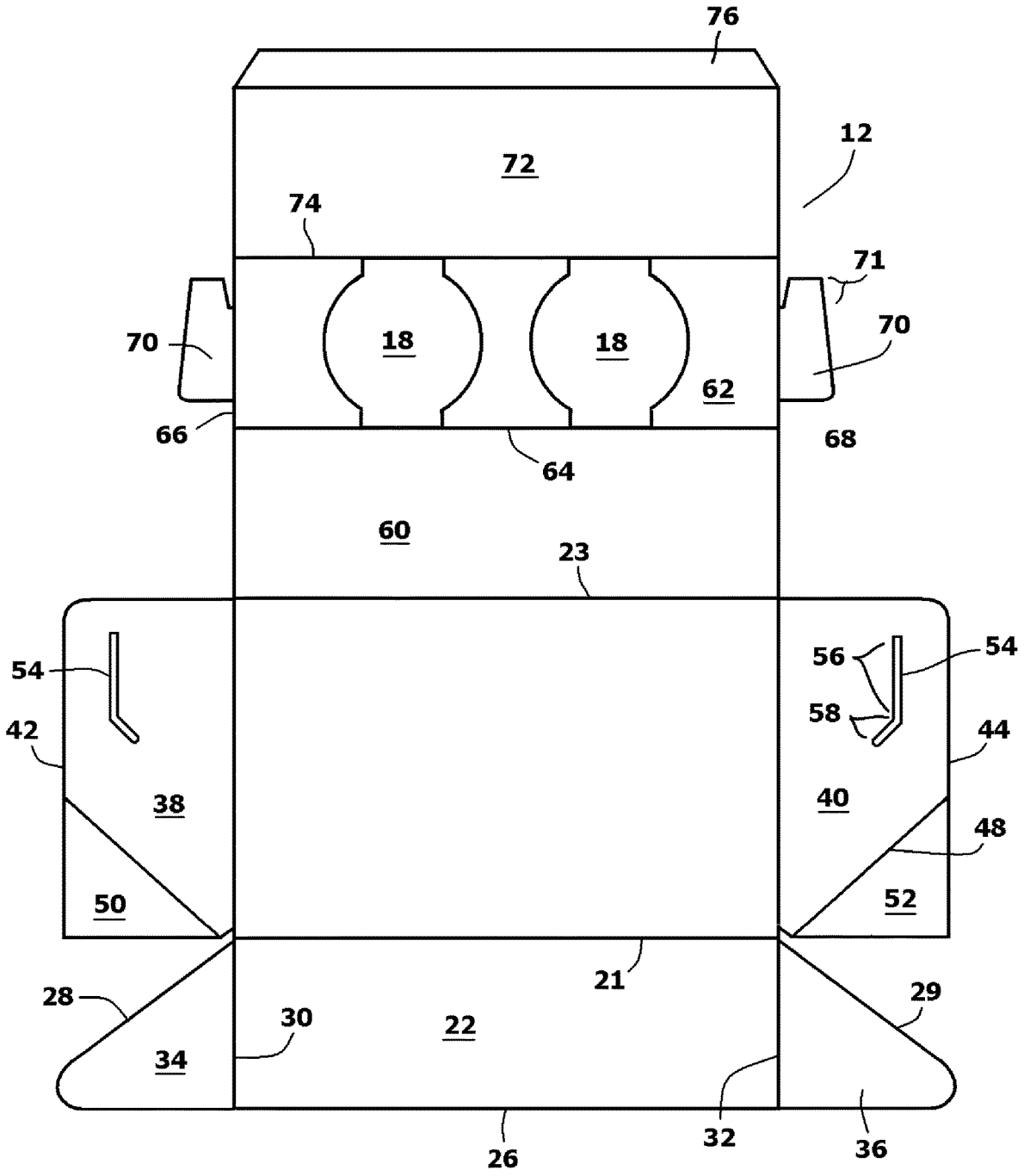
FIG. 2 is a front view of the stamped blank used to form the folded box of FIG. 1.

Referring to FIG. 2, in conjunction with FIG. 1, the paperboard blank 12 is shown that becomes the folded box 10. The paperboard blank 12 can be stamped from a large roll of paperboard. The paperboard blank 12 has various fold lines that divide the paperboard blank 12 into different panels and sections. The largest panel in the paperboard blank 12 is the base panel 20. The base panel 20 forms the bottom of the folded box 10. The base panel 20 is rectangular and is defined by four fold lines that include two long fold lines 21, 23 and two parallel short fold lines 25, 27. The walls of the folded box 10 attach to the base panel 20 along the four fold lines 21, 23, 25, 27. A front panel 22 extends from the base panel 20 along the first long fold line 21. The front panel 22 is shaped as a truncated triangle. The front panel 22 terminates with a first free edge 26 that is parallel to the first long fold line 21. The first free edge 26 is longer than the first long fold line 21. Two angled side edges 28, 29 connect the first long fold line 21 to the first free edge 26. A fifth fold line 30 and a sixth fold line 32 extend perpendicularly between the first fold line 21 and the first free edge 26. The fifth and sixth fold lines 30, 32 define triangular attachment flaps 34, 36 at opposite sides of the front panel 22.

Two side panels 38, 40 extend from opposite sides of the base panel 20. The side panels 38, 40 are divided from the base panel 20 along the short third and fourth fold lines 25, 27. The side panels 38, 40 terminate with free edges 42, 44 that are parallel to the third and fourth fold lines 25, 27 as well as two each other. The side panels 38, 40 have the same width as the front panel 22.

The seventh and eighth fold lines 46, 48 extend through the side panels 38, 40. The seventh and eighth fold lines 46, 48 define a triangular region 50, 52 within each of the side panels 38, 40. Additionally, a slot 54 is formed in each of the side panels 38, 40. The slot 54 is not straight, but is shaped as a dogleg. Each slot 54 has a straight section 56 that leads into an angled section 58. The straight sections 56 of the slots 54 are parallel to the free is parallel to the free edges 42, 44 of the side panels 38, 40. The angled sections 58 are inclined by an offset angle of between twenty degrees and forty-five degrees.

A rear panel 60 extends from the base panel 20 along the second long fold line 23. The rear panel 60 has a simple rectangular shape. The rear panel 60 extends into a cup receptacle panel 62, wherein the rear panel 60 and the cup receptacle panel 62 join along a ninth fold line 64. The cup receptacle panel 62 has one or more of the cup openings 18 formed therein. The cup receptacle panel 62 also has side edges 66, 68 that are perpendicular to the ninth fold line 64. Two locking tabs 70 extend laterally from the side edges 66, 68 of the cup receptacle panel 62. Each of the locking tabs 70 contains a flap section 71 that is not directly connected to the side edges 66, 68 of the cup receptacle panel 62. The locking tabs 70 are sized to engage the slots 54 in the side panels 38, 40 of the folded box 10, as is later explained.

A rectangular support panel 72 extends from the cup receptacle panel 62, opposite the rear panel 60. The rectangular support panel 72 is joined to the cup receptacle panel 62 along a tenth fold line 74. Lastly, a short attachment panel 76 extends from the rectangular support panel 72 opposite the cup receptacle panel 62.

Figure 3:
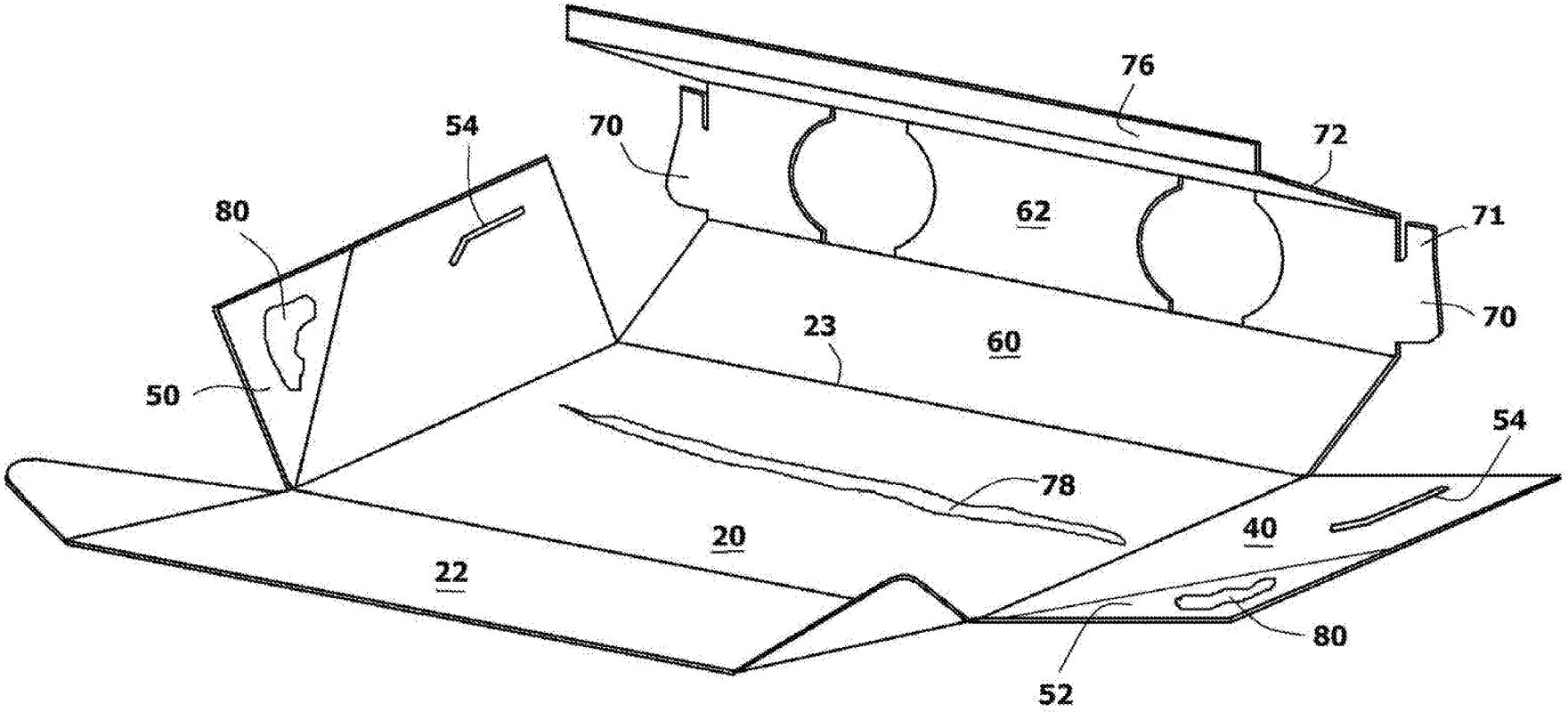
FIG. 3 is a perspective view of the folded box in a partially folded configuration.
Figure 4:
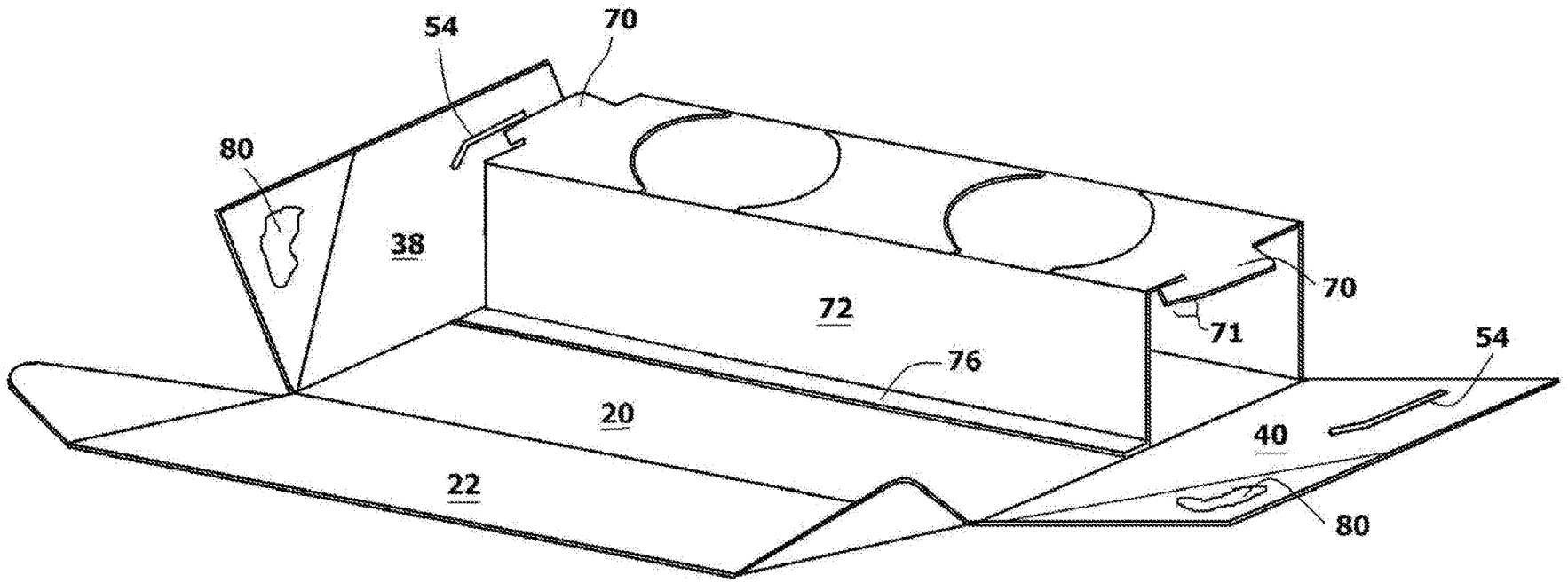
FIG. 4 is a perspective view of the folded box in a partially folded configuration.
Figure 5:
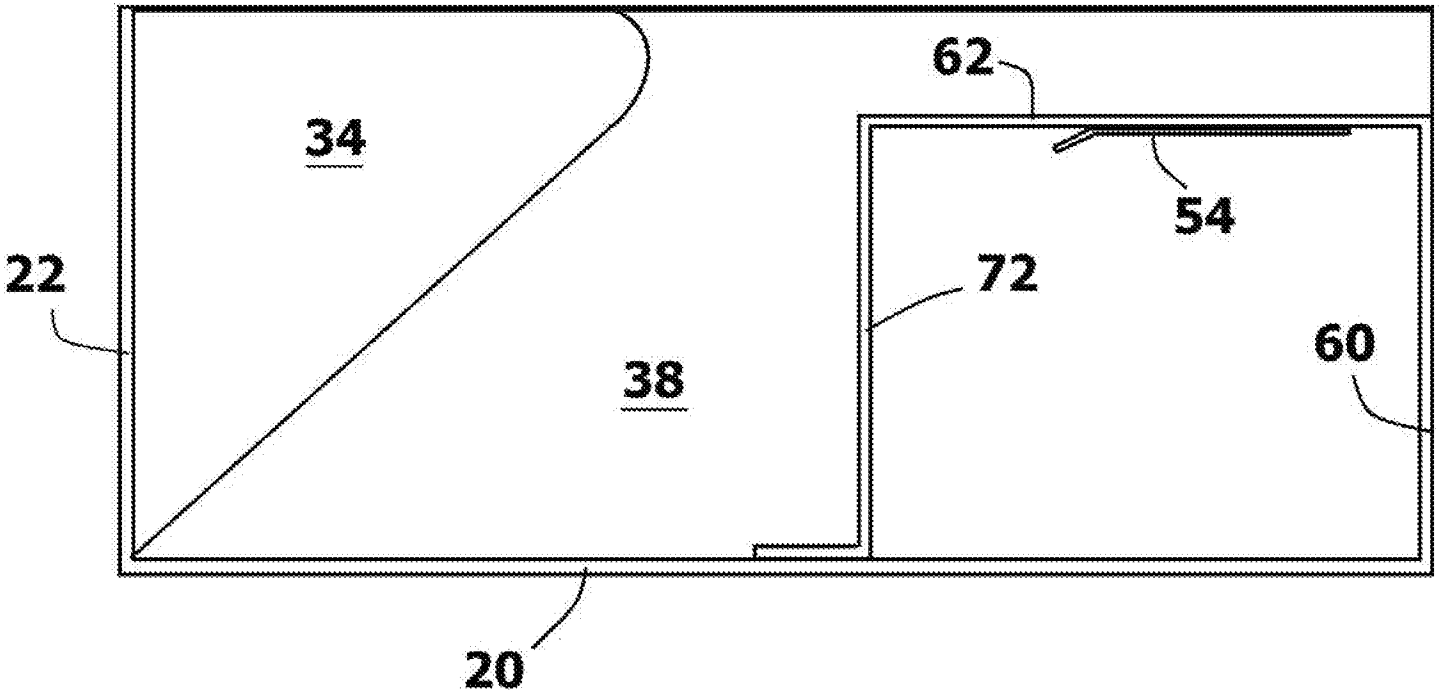
FIG. 5 is a cross section view of the exemplary embodiment of FIG. 1.

Referring to FIG. 3, FIG. 4 and FIG. 5 in conjunction with FIG. 1 and FIG. 2, it can be seen that a first line of adhesive 78 is applied to the center of the base panel 20. The rectangular support panel 72 and attachment panel 76 are folded against the base panel 20. The attachment panel 76 is then adhered to the base panel 20 with that adhesive 78. Likewise, dabs of adhesive 80 are applied to the triangular regions 50, 52 of the side panels 38, 40. The front panel 22 is folded against the base panel 20. The triangular attachment flaps 34, 36 at the sides of the front panel 22 are then adhered to the triangular regions 50, 52 of the side panels 38, 49 using the dabs of adhesive 80. The result is an assembled box in a collapsed condition.

The rear panel 60 is folded perpendicular to the base panel 20 at the second fold line 23. This manipulation creates the beverage rail 16, wherein the rectangular support panel 72 mimics the orientation of the rear panel 60. The cup receptacle panel 62 extends horizontally between the rear panel 60 and the rectangular support panel 72. In this position, the locking tabs 70 extend laterally from the cup receptacle panel 62 in the horizontal plane.

The side panels 38, 40 and the front panel 22 are all folded to be perpendicular to the base panel 20. The side panels 38, 40 contain slots 54. As the side panels 38, 40 become perpendicular to the base panel 20, the locking tabs 70 that extend from the cup receptacle panel 62 pass through the slots 54 in the side panels 38, 40. The slots 54 are not straight. Rather, the slots 54 are shaped as a dogleg. Consequently, the locking tabs 70 must be temporarily deformed to pass through the slots 54. As has been previously stated, each locking tab 70 has a flap section 71 that is not directly affixed to the cup receptacle panel 62. Each flap section 71 is easily bent and can pass through the angled section 58 of the slots 54. Once through the slots 54, the resiliency inherent in the material of the blank 12 causes the flap section 71 to rebound to its unbent state. Once the flap section 71 rebounds, the locking tab 70 can no longer pass through the slot 54. The locking tabs 70, therefore, lock the side panels 38, 40 in an orientation that is perpendicular to the base panel 20.

Returning to FIG. 1, in conjunction with FIG. 2 and FIG. 5, it can be seen that when fully assembled, the front panel 22, rear panel 60, and the two side panels 38, 40 are perpendicular to the base panel 20 and form the walls to the folded box 10. The food trough 14 is the open area of the folded box 12 between the front panel 22 and the rectangular support panel 72. The beverage rail 16 is comprised of the cup receptacle panel 62 being suspended between the rectangular support panel 72 and the rear panel 60. Once fully assembled, the folded box 10 is locked into its open configuration by the locking tabs 70. Accordingly, the folded box 10, once opened, will not close or collapse. If it is desired to close the folded box 10, the locking tabs 70 can be manipulated through the slots 54 and separated from the side panels 38, 40.

Figure 6:
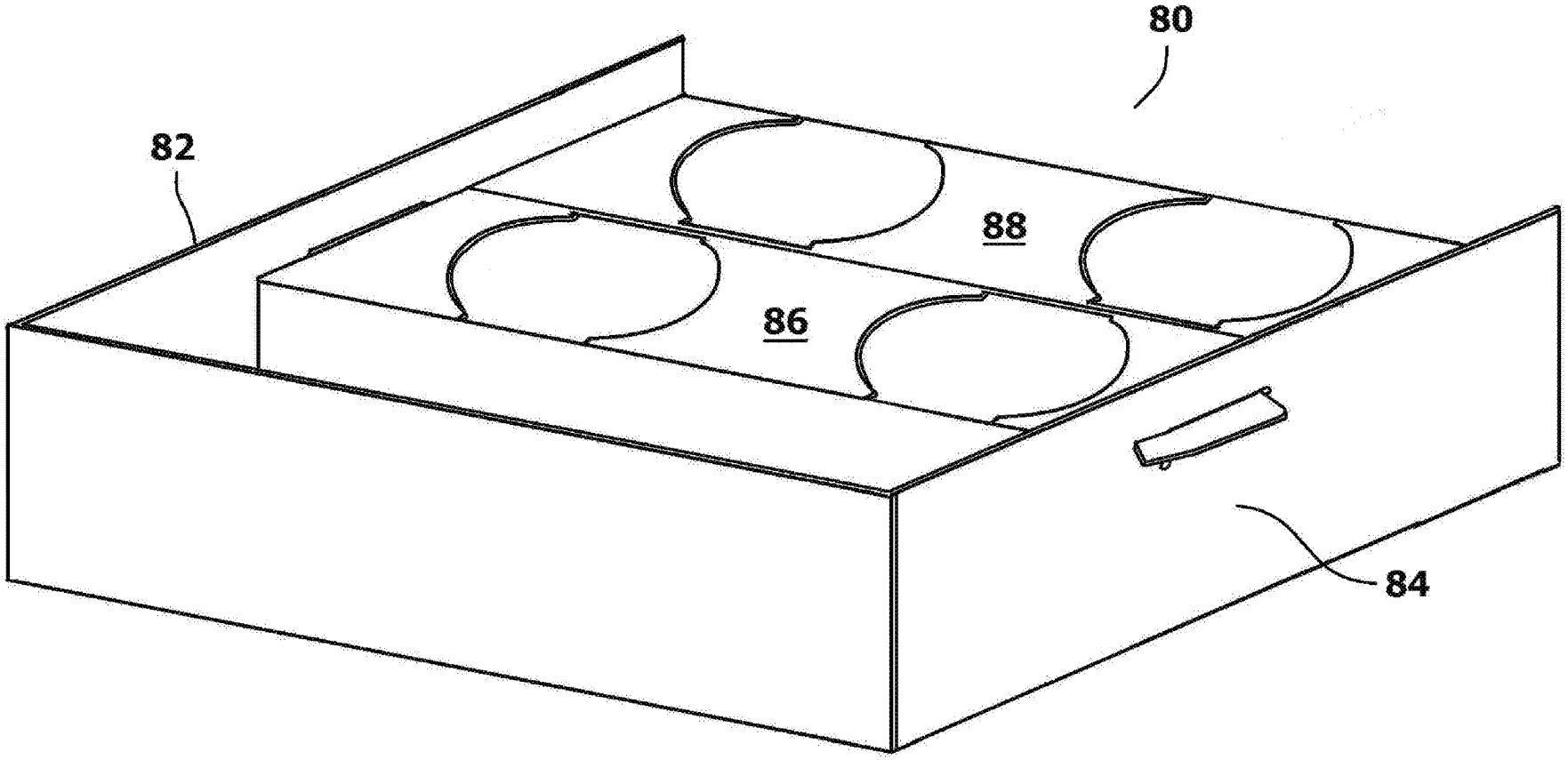
FIG. 6 is a perspective view of a second exemplary embodiment of a folded box.

Referring to FIG. 6, an alternate embodiment of a folded box 80 is shown. This embodiment has longer side panels 82, 84 and two cup receptacle panels 86, 88. In this manner, the folded box 80 can hold four beverages. This alternate embodiment is shown to illustrate that the present invention that is illustrated and described is merely exemplary and that a person skilled in the art can make many variations to that embodiment. For instance, the length and width of the folded box can be altered to the needs of a food supplier. All such embodiments are intended to be included within the scope of the present invention as defined by the claims.

What is claimed is:

1. A folding box, comprising:

a base panel defined between a first fold line, a second fold line, a third fold line and a fourth fold line;

a front panel coupled to said base panel along said first fold line;

two side panels coupled to said base panel along said third fold line and said fourth fold line, wherein said side panels have slots formed therethrough;

a rear panel coupled to said base panel along said second fold line;

a cup receptacle panel extending from said rear panel along a fifth fold line, wherein locking tabs extend from said cup receptacle panel;

a support panel extending between said cup receptacle panel and base panel, wherein said folded box is configurable between a folded configuration and an open configuration, and wherein said support panel is parallel to said rear panel when said folded box is in said folded configuration;

wherein when in said open configuration said locking tabs on said cup receptacle panel extend through said slots in said side panels, therein mechanically interconnecting said cup receptacle panel to said side panels.

2. The folding box according to claim 1, wherein said base panel, said rear panel, said side panels, said from panel, said cup receptacle panel, and said support panel are all part of a common paperboard blank.

3. The folding box according to claim 1, wherein said cup receptacle panel has at least one cup opening formed therein.

4. The folding box according to claim 1, wherein said support panel is adhesively affixed to said base panel.

5. The folding box according to claim 1, wherein said front panel has fold lines that define triangular attachment flaps.

6. The folding box according to claim 5, wherein said triangular attachment flaps are adhesively affixed to said side panels.

7. The folding box according to claim 1, wherein said front panel, said side panel, said side panels, said rear panel and said support panel are all perpendicular to said base panel when said folded box is in said open configuration.

8. The folding box according to claim 1, wherein said slots in said side panels each have a dogleg shape with a straight section and an angled section.

9. The folding box according to claim 1, wherein said locking tabs have flaps that temporarily bend to conform to said angle section of said slots when said locking tabs extends through said slots.

10. A folding box, comprising:

a base panel that extends between a front panel, a rear panel and two side panels, wherein said front panel, said rear panel and said two side panels are perpendicular to said base panel, and wherein slots are formed in said side panels that each have a dogleg shape with a straight section and an angled section;

a cup receptacle panel extending between said side panels, wherein said cup receptacle panel contain openings for holding cups and wherein said cup receptacle panel has locking tabs that extend through said slots and mechanically interlock said cup receptacle panel with said side panels.

11. The folded box according to claim 10, further including a support panel that extends between said base panel and said cup receptacle panel to help support said cup receptacle panel.

12. The folded box according to claim 11, wherein said support panel is adhered to said base panel.

13. The folded box according to claim 11, wherein said support panel, said cup support panel, said rear panel and said base panel are formed by fold lines in a common paperboard blank.

14. The folding box according to claim 13, wherein said front panel has fold lines that define triangular attachment flaps.

15. The folding box according to claim 14, wherein said triangular attachment flaps are adhesively affixed to said side panels.

16. The folding box according to claim 10, wherein said locking tabs have flaps that temporarily bend to conform to said angle section of said slots when said locking tabs extends through said slots.

17. A folding box, comprising:

a base panel defined between a first fold line, a second fold line, a third fold line and a fourth fold line;

a front panel coupled to said base panel along said first fold line;

two side panels coupled to said base panel along said third fold line and said fourth fold line, wherein said side panels have slots formed therethrough, wherein said slots in said side panels each have a dogleg shape with a straight section and an angled section;

a rear panel coupled to said base panel along said second fold line;

a cup receptacle panel extending from said rear panel along a fifth fold line, wherein locking tabs extend from said cup receptacle panel;

a support panel extending between said cup receptacle panel and base panel;

wherein said folded box is configurable between a folded configuration and an open configuration;

wherein when in said open configuration said locking tabs on said cup receptacle panel extend through said slots in said side panels, therein mechanically interconnecting said cup receptacle panel to said side panels.

* * * * *